United States Patent [19]

van Zijverden

[11] Patent Number: 4,807,783

[45] Date of Patent: Feb. 28, 1989

[54] WATER JET INJECTION DEVICE FOR USE WITH DISPENSERS FOR PRODUCING AND DISPENSING BEVERAGES MIXED OF FRUIT SYRUP OR CONCENTRATE AND WATER

[75] Inventor: Willem van Zijverden, Lübeck, Fed. Rep. of Germany

[73] Assignee: Dagma Deutsche Automaten - Und Getrankemaschinen GmbH & Co. KG, Rheinfeld, Fed. Rep. of Germany

[21] Appl. No.: 20,380

[22] Filed: Mar. 2, 1987

[30] Foreign Application Priority Data

Mar. 7, 1986 [DE] Fed. Rep. of Germany ..... 3607622

[51] Int. Cl.[4] ..... B67D 5/56

[52] U.S. Cl. ..... 222/129.2; 137/888; 137/895; 222/145; 222/148; 239/318

[58] Field of Search ..... 222/57, 129.1, 129.2, 222/144.5, 145, 148; 239/318, 570, 571; 137/605-607, 895, 893, 888, 889; 417/182, 183, 184

[56] References Cited

U.S. PATENT DOCUMENTS

| | | | |
|---|---|---|---|
| 2,785,830 | 3/1957 | Bauerlein | 222/57 |
| 2,919,073 | 12/1959 | Akselrad et al. | 239/318 X |
| 3,204,875 | 9/1965 | Langstroth | 239/318 |
| 3,357,598 | 12/1967 | Kraft | 239/318 X |
| 3,728,129 | 4/1973 | Sargeant . | |
| 4,552,286 | 11/1985 | Kückens et al. | 222/145 |

FOREIGN PATENT DOCUMENTS

| | | | |
|---|---|---|---|
| 724366 | 12/1965 | Canada | 222/129.2 |
| 3234957 | 3/1984 | Fed. Rep. of Germany . | |
| 2069458 | 8/1981 | United Kingdom | 222/129.2 |

*Primary Examiner*—Kevin P. Shaver
*Attorney, Agent, or Firm*—Herbert Dubno

[57] ABSTRACT

In a water jet injection device for use with dispensers for producing and dispensing beverages mixed of fruit syrup or concentrate there is provided a simple rinsing system which, if need arises, disturbs the water jet of the injection device with the aid of a rod-type member adjustable from outside in such a manner that in the mixing chamber an excess pressure and turbulent flow are generated in place of a vacuum, whereby the mixing chamber is separated from the supply conduit for fruit syrup or the like and an intensive cleaning of all of the parts of the injection device contacting the mixed beverage is effected with the aid of the water of the water jet.

4 Claims, 1 Drawing Sheet

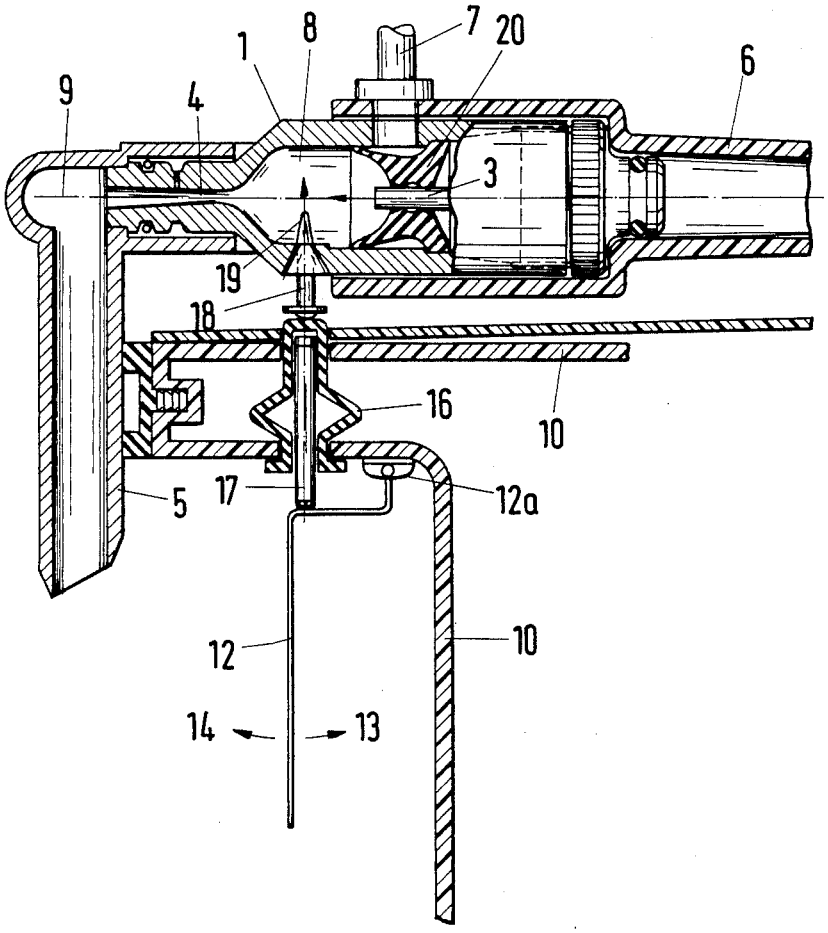
1
8
7
20
6
9
4
3
19
18
16
10
5
17
12a
12
10
14
13

WATER JET INJECTION DEVICE FOR USE WITH DISPENSERS FOR PRODUCING AND DISPENSING BEVERAGES MIXED OF FRUIT SYRUP OR CONCENTRATE AND WATER

FIELD OF THE INVENTION

This invention relates to a water jet injection device for use with dispensers for producing and dispensing beverages mixed of fruit syrup or concentrate and water.

More particularly, the invention relates to a device which comprises an elongated injector housing, in the interior of which a mixing chamber is formed into which a water jet pipe extends from one end of the injector housing which is adapted to be connected to a pressurized source of water and from which a nozzle portion extends for discharge of the mixture at the other end of the injector housing. At least one lateral intake opening is provided for connection with an intake conduit, in particular either for fruit syrup or concentrate, which has associated therewith a nonreturn valve means. This device can be also used for mixing water with pastes, mush or the like, for example to produce chocolates, soups, soap mixtures or the like.

BACKGROUND OF THE INVENTION

A device of the aforedescribed type is known, for example from German Offenlegungsschrift No. 32 34 957.

It is necessary and also common in most cases that the conduit for supplying either syrup or concentrate be associated with a non-return valve. This measure is necessary in order to prevent water or mixed beverage from entering the supply conduit upon the occurrence of a malfunction. Such non-return valve is also required because the mixing chamber and all of the parts of the system contacting the mixed beverage must be rinsed and cleaned with water for reasons of hygiene.

For this purpose, a controlled connection for pressurized water is known to be provided between the mixing chamber and the non-return valve to open for rinsing purposes when the supply conduit leading to the water jet pipe is closed. It is also possible to separate the non-return valve and the associated connection for syrup and concentrate from the injector housing and bring the connection of the injector housing into communication with a rinsing conduit.

All of these solutions are time-consuming and complicated and difficult in operation. As a consequence of the high operational expenditure, the system suffers from the danger of being not rinsed in sufficient short time intervals and thus hygienic problems may result.

OBJECT OF THE INVENTION

It is an object of the present invention to avoid the aforementioned drawbacks and improve a water jet injection device including the features of the generic clause so as to ensure a simple and reliable rinsing operation at low cost.

SUMMARY OF THE INVENTION

This object is achieved in accordance with the invention, by the provision of a means which is adjustable from outside is mounted on the injector housing, this means being movable from an inoperative state into an operative deflecting state into the path of the water jet leading from the water jet pipe to the nozzle portion.

The water jet passed through the water jet pipe and inducing injector action is utilized, if need arises, for rinsing the mixing chamber and all of the parts of the injection device contacting the mixed beverage. This is achieved because when rinsing is required, the water jet is so disturbed that injector action is reversed and an increase occurs in pressure in the mixing chamber caused by the water jet.

As an effect of the disturbance of the water jet, the latter is at the same time converted into a turbulent flow within the mixing chamber, whereby the rinsing and cleaning effects are substantially favored.

No particular water connection for the rinsing operation is required. Nor are manipulations or controlling measures required for operating this particular water connection.

As operation is extremely simple, the proper rinsing of the injection system is decisively favored and, consequently, no hygienic problems need be feared.

The arrangement is so simple in construction and operation that it is also possible to automatically effect a rinsing operation of the system as an end phase of each beverage dispensing step. Irrespective of this point, actuating elements already provided at the dispenser and, for example, employed for effecting the mixed beverage discharging operation can be used for effecting the rinsing operation either in dependance upon the beverage dispensing operation or arbitrarily.

BRIEF DESCRIPTION OF THE DRAWING

The above and other objects, features and advantages of the present invention will become more readily apparent from the following description, reference being made to the accompanying drawing, the sole Figure of which is a vertical sectional view of a water jet injection device according to the invention.

SPECIFIC DESCRIPTION

In the embodiment shown, the water jet injection device includes an elongated, in the present case horizontally positioned, injector housing 1 which is arranged in an accommodation piece 6 of the dispenser and the rearward end of which is adapted to communicate with a pressurized water conduit, while the forward end includes a nozzle portion 4 on which a dispensing piece 5 is sealingly and pivotably arranged. Behind the nozzle portion 4 a mixing chamber 8 is provided which is rearwardly closed by means of a sealing element 20 which sealingly also encircles the water jet pipe 3 centrally aligned along the axis 9 of the injector housing 1. The sealing element 20 closes in non-return valve-type fashion the lateral connection conduit 7 for fruit syrup or concentrate in the absence of the injector action.

In the wall of the injector housing 1 a deflecting or rod-type member 19 is sealingly positioned but can be displaced in radial direction, said member being shown in the Figure in its rest position and, therefore, outside of the path of the water jet leading through the mixing chamber 8 from the water jet pipe 3 to the nozzle portion 4. Outside of injector housing 1 the rod-type member includes an actuating element 18. The arrangement comprises (not shown) a biasing element which endeavours to normally hold the rod-type member 19 in the inoperative, retracted state.

An actuating element, in the embodiment shown, in the form of a tappet 17 is provided in the dispenser housing at a point accessible from outside, said tappet being disposed in a bellows-type portion 16 so as to be axially movable and sealed in such a manner that when the tappet 17 is pressed a force is applied to the actuating element 18 and the rod-type member 19 is moved into the path of the water jet. The tappet 17 and thus the actuating element 18 can be actuated in various ways. For instance, it is possible to provide an actuation means in the dispenser which in dependence upon a dispensing operation being effected, is actuated in such a manner that in the last phase of the dispensing operation a force is applied to the actuating element 18 so that the residual amount of water required for the mixed beverage is utilized as rinsing water by disturbing in the last phase of the dispensing operation the water jet in the mixing chamber 8, whereby the sealing element 20 of the nonreturn valve-type stops the further supply of fruit syrup or concentrate and generates a turbulent rinsing flow in the mixing chamber and in the nozzle portion 4 as well as in the dispensing piece 5.

In the embodiment shown, the injector housing is arbitrarily rinsed. It is advantageous to provide the actuating element in the form of a paddle 12 which is secured to the housing 10 of the dispenser below the dispensing piece 5 so as to be pivotable at point 12*a*. This paddle is usually disposed in the insertion path of the cup in the dispensing area of the dispenser and usually serves to effect the mixing and dispensing operations when a cup has been properly placed in the dispenser. The movement of the paddle 12 is indicated by arrow 13. Paddle 12 is so designed and positioned that upon movement opposite to the effecting movement indicated by arrow 13, which means, when moved in the direction indicated by arrow 14, paddle 12 acts upon the tappet 17 to so effect the rinsing operation in the manner described hereinbefore.

As increased water pressure which preferably ranges between approximately 3.5 and 6 bar prevails in the device described hereinbefore. At this high pressure a highly efficient cleaning of all of the important areas of the injection device results with the aid of the deflecting means.

When the water jet issuing into the mixing chamber is influenced in a controlled manner, the mixture (parts of water and admixed material) can be regulated as well. An adjusting means can be provided for this purpose with the aid of which the final position of the deflecting member in front of the jet can be adjusted when this member is moved towards the jet during the dispensing operation.

The position during the rinsing operation can remain uninfluenced thereby.

I claim:

1. A water-jet injection device for dispensing a mixture of water with another substance, said water jet injection device comprising:

an elongated body having an axis and defining a mixing chamber, said body being formed at one end thereof with a restricted throat lying along said axis and communicating with said chamber, and a discharge channel flaring outwardly from said throat;

plug means in said body at an opposite end thereof for delimiting said chamber in said body;

a water-supply tube extending completely through said plug means along said axis and having a free end projecting beyond said plug means into said chamber;

means for connecting an opposite end of said water-supply tube to a source of water under pressure so that pressurized water flowing from said free end of said tube is directed in a high-velocity stream into said throat;

an intake conduit opening laterally into said body and said chamber at an intake opening for supplying said substance to said chamber for mixing with water therein for discharge of the mixture through said channel;

means on said plug means forming a nonreturn valve between said opening and said chamber adapted to pass flow of said substance into said chamber when said high-velocity flow is unimpeded but blocking flow from said chamber into said opening in the absence of the unimpeded high-velocity flow; and a deflecting element mounted for movement in said body between a deflecting position wherein said element projects into said chamber into the flow of water from said free end of said tube to interfere with said high-velocity stream, and an ineffective position wherein said element is retracted out of the path of said high-velocity stream.

2. The device defined in claim 1 wherein said element is a rod displaceable linearly in said body in a direction perpendicular to said axis.

3. The device defined in claim 2 wherein said flap has a portion projecting from said body and engageable by an actuator external to said body for displacing said element between said positions.

4. The device defined in claim 3 wherein said actuator is a member pivotally connected to said body and swingable between a dispensing position and a rinsing position wherein said actuator displaces said element.

* * * * *